US006688281B1

(12) United States Patent
Woolford et al.

(10) Patent No.: US 6,688,281 B1
(45) Date of Patent: Feb. 10, 2004

(54) ENGINE SPEED CONTROL SYSTEM

(75) Inventors: Richard Albert Woolford, Connolly (AU); Troy Bradley Epskamp, Kiara (AU)

(73) Assignee: Orbital Engine Company (Australia) Pty., Limited, Balcatta (AU)

( * ) Notice: Subject to any disclaimer, the term of this patent is extended or adjusted under 35 U.S.C. 154(b) by 0 days.

(21) Appl. No.: 09/806,519

(22) PCT Filed: Jun. 9, 2000

(86) PCT No.: PCT/AU00/00650

§ 371 (c)(1),
(2), (4) Date: Apr. 18, 2001

(87) PCT Pub. No.: WO00/77370

PCT Pub. Date: Dec. 21, 2000

(30) Foreign Application Priority Data

Jun. 11, 1999 (AU) ..... PQ0955

(51) Int. Cl.[7] ..... F02D 17/02

(52) U.S. Cl. ..... 123/333; 123/335; 123/436; 701/110

(58) Field of Search ..... 123/333, 339, 123/198 D, 335, 339.19, 352, 481; 701/110

(56) References Cited

U.S. PATENT DOCUMENTS 4,932,379 A * 6/1990 Tang et al. ..... 123/436
5,218,939 A * 6/1993 Stumpp ..... 123/339
5,311,773 A * 5/1994 Bradshaw et al. ..... 73/116
5,623,906 A 4/1997 Storhok
5,726,892 A * 3/1998 Tang et al. ..... 701/110
5,775,290 A * 7/1998 Staerzl et al. ..... 123/335
5,915,272 A * 6/1999 Foley et al. ..... 73/115
6,302,082 B1 * 10/2001 Nagatani et al. ..... 123/305
2002/0152987 A1 * 10/2002 Woolford et al. ..... 123/333

FOREIGN PATENT DOCUMENTS

GB 2162973 2/1986
GB 2206156 11/1988

* cited by examiner

*Primary Examiner*—Willis R. Wolfe
*Assistant Examiner*—Johnny H. Hoang
(74) *Attorney, Agent, or Firm*—Rothwell, Figg, Ernst & Manbeck

(57) ABSTRACT

A method of controlling the engine speed of an internal combustion engine, the method providing the steps of determining the speed of the engine at a given time, determining the change in the speed of the engine from a previous determination of the engine speed, and using the values for engine speed and change in engine speed to determine whether a future event should be a combustion event or a non-combustion event.

35 Claims, 2 Drawing Sheets

ENGINE SPEED CONTROL SYSTEM

BACKGROUND OF THE INVENTION

This invention relates to internal combustion engines, and in particular a method and control system for use in such engines to control the revolutionary speed thereof. The invention will in the main be described in relation to a direct injection two-stroke spark ignition engine, although it is to be appreciated that use of the method and control system in relation to other engine applications is also envisaged.

Internal combustion engines are used in a wide variety of applications, such as in motor vehicles (cars, all terrain vehicles and two-wheeled vehicles) and watercraft including personal watercraft (PWC's) and outboard engines for boats. In many of these applications, it may be important in the operation of the engine to be able to control the rotational speed of the engine.

For example, a requirement to limit engine speed may arise in order to protect an engine from damage which could be sustained during overly high speed operation, or to limit the overall speed of the vehicle being powered by the engine. Such speed limiting may be desirable in instances where the operator of the vehicle is inexperienced or if maximum speed limits are provided for a given situation.

PWC's are particularly susceptible to overspeed conditions as these craft are often operated at or near their maximum engine speed. During wave jumping for example, a popular activity of PWC enthusiasts, and during rough water conditions, the driving mechanism of the PWC is liable to rise above the water level, thereby creating a sudden drop in load on the engine, and hence an associated increase in engine speed. In this regard and since it is common for PWC's to be operating at or close to maximum engine speed when wave jumping or in rough water, it is important to avoid any "over-revving" of the PWC engine as this may result in damage to the engine.

In the past most engines simply had no maximum speed control except for the engine's natural maximum limit, leaving the engine particularly susceptible to damage from operation at overly high speed. More recently, mechanical devices such as governors have been used, and developments in the electronic control of engines have resulted in a greater ability to control or restrict the maximum speed of internal combustion engines.

For example, in one such development, it has been proposed to prevent further increases in engine speed once the engine reaches a preset upper speed limit by skipping combustion events. In one possible scenario, the ignition event is simply not enabled, and the combustion event does not occur. This method however has the disadvantage that fuel is still delivered into the combustion chamber, and passes out through the engine exhaust system into the environment, in an unburnt state. This is both a significant waste of fuel and can be harmful to the environment. Additionally, residual unburnt fuel can remain in the combustion chamber and adversely affect a subsequent combustion event by reducing the predictability and certainty with regard to the amount of fuel in the combustion chamber.

Another known option is to reduce the fuelling level to the engine so that reduced power is produced thereby and engine speed is reduced. However, whilst this appears to be a reasonable option, bulk air flow through the combustion chamber is not affected by simply reducing the fuelling levels, and the overall result, particularly in the case of wide open throttle operation, may be enleanment of the air fuel ratio of the combustion mixture in the combustion chamber. Such enleanment can result in lean misfire and the overheating of the engine, particularly at high operating loads.

The present Applicant has developed a two-fluid fuel injection system as disclosed in, for example, the Applicant's U.S. Pat. No. 4,693,224, the contents of which are incorporated herein by reference. The method of operation of such a two-fluid fuel injection system typically involves the delivery of a metered quantity of fuel to each combustion chamber of an engine by way of a compressed gas, generally air, which entrains the fuel and delivers it from a delivery injector nozzle. Typically, a separate fuel metering injector, as shown for example in the Applicants U.S. Pat. No. 4,934,329, delivers, or begins to deliver, a metered quantity of fuel into a holding chamber within, or associated with, the delivery injector prior to the opening of the delivery injector to enable direct communication with a combustion chamber. When the delivery injector opens, the pressurised gas, or in a typical embodiment, air, flows through the holding chamber to entrain and deliver the fuel previously metered thereinto to the engine combustion chamber.

In an engine operated in accordance with such a two-fluid fuel injection strategy, there are therefore distinct events in the combustion process, including a fuel metering or fuel event, an air delivery or injection event (as opposed to the bulk air delivery into the combustion chamber which occurs separately), and an ignition event. The engine management system typically required to implement such a strategy includes an electronic control unit which is able to independently control each of the fuel, air, and ignition events to effectively control the operation of the engine on the basis of operator input. Accordingly, the use of such a two-fluid fuel injection system allows combustion events to be partially or completely cancelled, producing a non-combustion event in a selected cylinder.

In the context of this specification, unless otherwise indicated, an "event" is either a combustion event, or a non-combustion event which occurs where the combustion event would have occurred if it had been scheduled.

Hence, in a two-fluid fuel injection system, it is possible for the electronic control unit to simply cut one or more cylinders of the engine by simply providing no fuel for an event, the event then simply consisting of compressing air which is substantially free of fuel, and allowing it to expand again, thus not contributing to any additional engine speed and avoiding the negative consequences of other forms of engine speed control. However, simply cutting a fuel event may result in a certain degree of "drying" of the delivery injector nozzle which would still have a quantity of air being delivered therethrough. This may result in the next combustion event upon reinstatement of the cut cylinder being less than satisfactory.

In a similar manner, it is possible for the electronic control unit to bypass or cut one or more cylinders of the engine by simply not initiating an air event. Thus, any fuel which is metered into the delivery injector nozzle is simply not delivered thereby, hence not contributing to any additional engine speed. However, such a strategy may also have associated problems in that upon reinstatement of the previously bypassed cylinder, the next combustion event may result in twice as much fuel being delivered to a cylinder. That is, the previous undelivered fuel quantity together with a subsequent metered quantity of fuel are delivered in the one injection event upon reinstatement of the previously bypassed cylinder.

It should be understood that cutting the ignition event as alluded to hereinbefore is still an option for producing a non-combustion event in such a two-fluid injection system, but this option still possesses the associated disadvantages as described hereinbefore.

Accordingly, in such a two-fluid injection system, it may be more beneficial to ensure that neither the fuel event nor the air event occur when seeking to cut a cylinder and hence produce a non-combustion event. In this regard, in order to effectively produce a non-combustion event in such a manner, it is obviously better to determine whether a particular combustion event should be skipped, and then arrange the cancellation of the fuel and air events prior to the start of the actual fuel metering for the combustion event.

However, in the above-mentioned two-fluid fuel injection system, the start of the fuel event, at high loads, may take place up to around 700 degrees before top dead centre (BTDC) of the compression stroke of the combustion event which is being scheduled, though it would more commonly occur at around 500–550 degrees BTDC for typical high load operation. A further complicating issue is that, together with the decision as to whether or not to provide a combustion event being made early, there may be a number of events which will affect the engine speed which are already scheduled to occur between the decision and the actual event occurring or not occurring. Further, the outcome of the impact of the event on the engine speed may not be known until some time after top dead centre (ATDC), possibly at around 180 degrees ATDC. Hence, the decision to have a combustion event or a non-combustion event is effectively needing to be made some time before the outcome of an earlier scheduled event is known (i.e., upon the engine speed).

Such a delay may correspond to about five combustion or non-combustion events in a typical two cylinder two-stroke engine and as a result of this, control of the engine speed can be unpredictable. That is, due to the way in which fuel and air events are scheduled by the electronic control unit, and also due to the processing delay within the electronic control unit, a decision to allow or cancel a combustion event will need to be made effectively two to three events prior to when the scheduled event would normally occur. This process is made somewhat more difficult by the fact that when this decision is made, depending on the engine operating speed, a number of other combustion events or non-combustion events may have already been scheduled and the effect that these events will have on the engine speed is unknown.

Whilst some of the above-mentioned difficulties are more pronounced in two-fluid fuel injection systems, similar difficulties may also be experienced with single fluid fuel injection systems.

BRIEF SUMMARY OF THE INVENTION

Accordingly, it is an object of the present invention to provide an engine speed control method which at least ameliorates some of the above problems.

According to a first aspect of the present invention, there is provided a method of controlling the engine speed of an internal combustion engine, the method providing the steps of determining the speed of the engine at a given time, determining the change in the speed of the engine from a previous determination of the engine speed, and using the values for engine speed and change in engine speed to determine whether a future event should be a combustion event or a non-combustion event.

The determination of the change in the speed of the engine is effectively used to provide an indication of the overall load that the engine is experiencing. Hence, this determination can take account of a number of aspects which may effect the speed of the engine such as in particular the load placed on the engine due to its working environment. For example, in the case of a marine application, the change in engine speed and hence the overall load on the engine will be affected by whether the driving mechanism of the engine is in or out of the water.

Conveniently, the method as described is used to control the engine speed to a predetermined target speed. Hence, in determining whether a future event should be a combustion event or a non-combustion event, the method is providing for feed-forward control of the engine speed. That is, the method is applied to firstly effectively predict what the engine speed will be after one or a number of fuelling events in the future if the operating conditions remain unchanged, and then to decide whether the next events should be combustion events or non-combustion events so as to target a predetermined engine speed setting.

Preferably, where it is determined that a noncombustion event is required, no fuel is supplied to the combustion chamber. Alternatively, ignition may be cut such that a noncombustion event results in the respective combustion chamber. Other means of generating a non-combustion event may also be implemented.

Conveniently, fuel is supplied to the engine via a two-fluid direct fuel injection system, and where it is determined that a non-combustion event is required, no fuel is metered into a delivery injector of the two-fluid fuel injection system and no air is passed through the delivery injector into the combustion chamber. Hence, in such a two-fluid injection system, both the air and fuel events are cancelled where it is determined that a non-combustion event is required.

Preferably, a decision as to whether a particular event is to be a combustion event or a non-combustion event is made prior to the beginning of the fuelling operation for that event. The decision as to whether a particular event is to be a combustion event or a non-combustion event may be made at over 360 degrees BTDC for the event which is being determined, and may be at around 710 degrees BTDC. Essentially, at higher engine speeds, a decision will need to be made at such an earlier time as it is possible that one or more events are already scheduled to occur prior to the event for which the decision is being made. This is particularly the case for two-fluid fuel injection systems where it is typical at higher engine speeds for a number of fuel and air events to be already scheduled to occur prior to the event upon which the decision to cancel or enable the event is being made.

Preferably, the method is applied during high speed operation of the engine, and is used to avoid the occurrence of overspeed conditions. Conveniently, the method is applied to control the engine speed during high speed operation to a threshold target engine speed. Hence, the method is used to provide an indication of what the engine speed will be after one or a number of events in the future and to then control the engine speed to the threshold target speed by enabling a subsequent combustion event to occur or by deciding that a non-combustion event should occur. Thus, the method enables the operator or rider of the craft within which the engine is arranged to maintain the engine speed at or close to the maximum allowed speed without damaging the engine.

Accordingly, the method provides for feed-forward overspeed control by targeting a predetermined threshold engine speed and scheduling a sequence of combustion events and/or non-combustion events which will maintain the engine speed as close to the target engine speed as possible.

Preferably, the method is applied when the engine speed exceeds a predetermined entry speed. Conveniently, this entry speed is set at a value lower than the target or threshold speeds to which the engine speed is controlled. Hence, as the speed of the engine climbs towards the predetermined target or threshold speed, it will preferably only be controlled according to the present method once it exceeds the lower entry engine speed. This entry engine speed may typically be 1000 rpm less than the target engine speed.

Preferably, an adaption value is calculated on the basis of engine speed and the effective load levels as determined for a given event. The adaption value may be used in determining whether the future event should be a combustion event or a non-combustion event. Where the effective load on the engine is high, the adaption value may be set so as to increase the likelihood of a combustion event as compared to a non-combustion event. This is typically consistent with small changes in the engine speed such as for a marine engine operating at high speed with the driving mechanism of the engine continuously being located in the water. Where the effective load on the engine is low, the adaption value may be set so as to increase the likelihood of a non-combustion event as compared to a combustion event. This is typically consistent with larger changes in the engine speed such as when the driving mechanism of a marine engine operating at high speed leaves the water.

Preferably, a filter is applied to the rate of change of the adaption value to limit the rate of change of the adaption value. The filter may be dependent on whether the load on the engine is increasing or decreasing.

Conveniently, the fuelling level supplied to the engine may be used as a determination of the load on the engine. Conveniently, once it has been determined that the engine speed is likely to exceed the predetermined threshold engine speed, a preset pattern of combustion events and non-combustion events is implemented in at least one injector to control the engine speed in relation to the threshold engine speed.

According to a second aspect of the present invention, there is provided a control system for an internal combustion engine in which current engine speed and the change in engine speed from a previous determination are taken into account when determining whether a future event should be a combustion event or a non-combustion event.

Preferably, the second aspect of the present invention provides a control system for operation in accordance with each of the preferred embodiments of the first aspect of the present invention.

Specifically, there may be provided a system for targeting a predetermined threshold or target engine speed and scheduling a sequence of combustion events and/or non-combustion events which will maintain the engine speed as close to the target engine speed as possible.

The system may also be further adapted to provide for limitation of overspeed conditions in the use of the internal combustion engine.

Preferably, the system may provide an adaption value, which is calculated on the basis of engine speed and the effective load levels as determined for a given event. The adaption value may be used in determining whether a future event should be a combustion event or a non-combustion event.

According to a third aspect of the present invention, there is provided an Electronic Control Unit arranged to implement a control strategy for an internal combustion engine, in which current engine speed and the change in engine speed from a previous determination are taken into account when determining whether a future event should be a combustion event or an non-combustion event.

According to a fourth aspect of the present invention, there is provided a method of controlling the rotational speed of an internal combustion engine, the method including the steps of determining whether the engine speed is likely to exceed a predetermined threshold engine speed, and implementing a pattern of combustion events and non-combustion events in at least one engine cylinder in order to modify the effective fueling level to the engine cylinders so as to control the engine speed in relation to the threshold engine speed.

Preferably, the prevailing fueling level for an individual cylinder in which a combustion event is to occur is not altered. That is, whilst the effective fueling level to the engine may, for example, be reduced, the fueling level to the individual cylinders which are not cut (i.e., within which a combustion event will be allowed to occur) will remain unchanged. In this way, the operational cylinders will continue to operate with the same prevailing air/fuel ratio.

Preferably, the method of controlling the speed of the engine is affected so as to limit the engine speed. Preferably, the determination of whether the engine speed is likely to exceed the predetermined threshold engine speed is based on the engine speed determined for a given time. Preferably, the requirement for reduced speed may be determined on the basis of both the engine speed and the effective load on the engine whereby the latter is established by determining the change in engine speed from a previous determination thereof. In this regard, once it is determined that the engine speed will exceed a predetermined threshold engine speed and the effective load on the engine has been determined, the effective fueling level required to maintain the engine speed at the threshold engine speed can be calculated. On the basis of this desired effective fueling level, one of a number of preset patterns of combustion events and non-combustion events can be implemented to control the engine speed.

Preferably, the method of controlling the speed of the engine is effected by implementing a repeatable pattern of combustion events and/or non-combustion events.

Preferably, the method is used to avoid overspeed conditions in the engine operation. The pattern of combustion events and non-combustion events may provide a greater number of non-combustion events per sequence when there are effectively lower load conditions on the engine, and a lower number of non-combustion events per sequence when the engine effectively experiences higher load conditions.

Accordingly, the method of prescribing a sequence of combustion events and/or non-combustion events results in a reduction of the torque output of the engine and hence the speed thereof in a predictable manner. This is achieved without regulating or reducing the fuelling of a number of events and hence without running a variety of air/fuel ratios between different engine cylinders. This is particularly applicable to wide open throttle operation where the engine speed is typically close to the maximum operating speed of the engine wherein reduced fuelling levels may cause engine detonation and overheating.

Unless clearly indicated otherwise, the expression "top dead centre" (TDC) shall be taken to refer to the location at top dead centre of a piston within a cylinder of a corresponding engine during the event which is being determined by the method or control system of the present invention. A reference to an angle "before top dead centre" (BTDC) or "after top dead centre" (ATDC) shall be taken as a reference to the number of degrees of rotation of the engine before or after the top dead centre position for the event which is being determined by the method or control system of the present invention.

The method and control system of the current invention is particularly applicable to marine and PWC applications. It is also however conceived that this invention may also be applicable to other engine applications and hence the invention is not deemed to be limited in its application.

Further, whilst the current invention is particularly applicable to dual fluid fuel injection systems, it is not intended to be limited as such and can be equally applicable for use with single fluid fuel injection systems. Still further, the current invention has applicability to both two and four stroke cycle engines.

BRIEF DESCRIPTION OF THE DRAWINGS

The invention will now be described in relation to a preferred embodiment of the invention, and with particular reference to the accompanying drawings, in which.

DETAILED DESCRIPTION OF THE PREFERRED EMBODIMENTS

Figure 1:
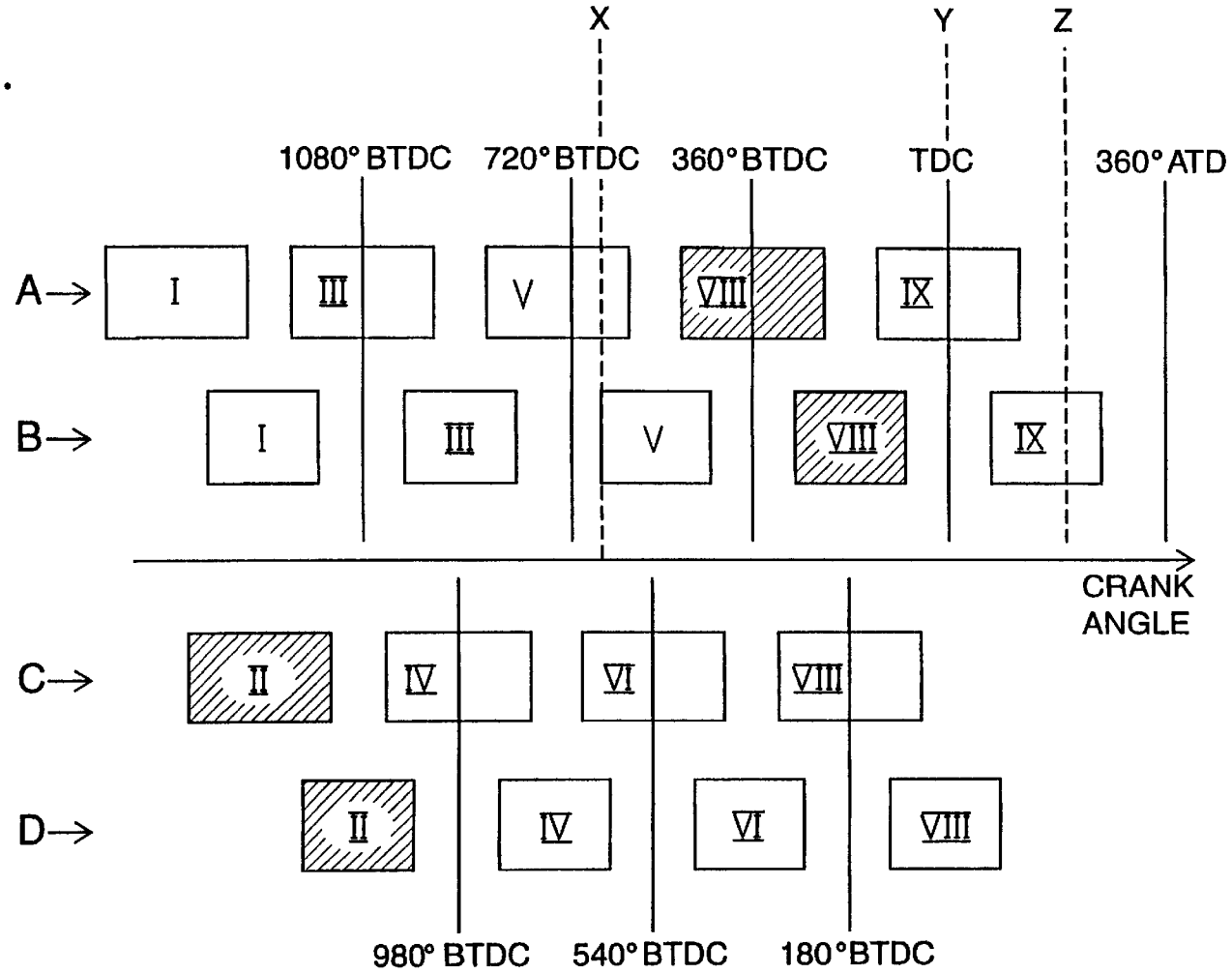
FIG. 1 is a schematic representation of fuel and air event timing in a two-fluid direct fuel injection system in a two cylinder engine.

Turning firstly to FIG. 1, this illustration sets out the fuel metering event timings and delivery injector air flow timings with respect to crank angle for a series of combustion events in a two cylinder, two-stroke, two-fluid direct injection engine. Zero degrees crank angle has been set for the purposes of this example as the TDC for the event for which a decision is being made with regard to whether a combustion event or a non-combustion event is to take place. In this example, the event in question is event VII as indicated in FIG. 1 and the TDC for this event is indicated by the reference Y.

In this illustration, Row A shows the crank angle timings of the fuelling or fuel metering event for the first cylinder of the engine, whilst Row B shows the timings of the delivery injector air event for the first cylinder. Row C shows the fuelling event timings for the second cylinder of the engine, whilst Row D shows the delivery injector air event timings for the second cylinder of the engine. The injector air and fuel events for the first and second cylinders respectively are approximately 180 degrees out of phase, as is usual in such two cylinder engines.

The ignition event generally occurs at around TDC for the respective cylinder following the completion of the injector air flow event, and the fuel event, the air event and the ignition event together make up the combustion event. For a non-combustion event, any or all of these three events may be scheduled not to occur, though it is preferred that none of the events occur for most efficient operation of the engine. As noted above, this example focuses specifically on the decision as to whether or not event VII should be a combustion event or a non-combustion event.

The first event shown is indicated by reference numeral I, which is taken to have occurred at approximately 1080 degrees BTDC. The physical outcome of this event in terms of its effect on the engine speed are known for the purposes of the decision to be made for event VII. Engine speed is typically detected by known electronic means, and the effect on engine speed as a result of a particular event which has actually occurred is obtainable approximately 180 degrees after top dead centre of that event. Hence, the effect on engine speed of event II, which is taken to have occurred at around 900 degrees BTDC, will be known at approximately 720 degrees BTDC. As the decision regarding whether event VII should be a combustion event or a non-combustion event is not made until approximately 710 degrees BTDC, indicated on FIG. 1 by the reference X, the actual physical outcome of event II can be taken into account when making a decision regarding event VII.

The actual outcomes in terms of the effect on engine speed of the next four events, III, IV, V, and VI, are not available, as these have not yet been determined at the time of needing to make the decision regarding event VII. In fact, events IV, V and VI have not yet occurred. However, the electronic controller does take into account whether each of these events is a combustion event or a non-combustion event, as these decisions have been made and are known.

The electronic controller has also calculated an adaption value based on the effective load on the engine. As alluded to hereinbefore, the adaption value is calculated to take account of the effect a combustion event or a non-combustion event will have on the speed of the engine. For example when the engine is experiencing a high effective load, a combustion event may cause a small increase in the engine speed whereas a non-combustion event may cause a large decrease in the engine speed. Similarly, when the engine is experiencing a low effective load, a combustion event may cause a large increase in engine speed whilst a non-combustion event may cause a small decrease in engine speed. By understanding the effect a combustion event or a non-combustion event may have on the speed of the engine and assigning an adaption value based on this effect, such a value can then be applied to affect the desired control of the engine speed. The utilisation of such an adaption value enables the engine speed to be targeted more closely to the maximum engine speed limit. As alluded to hereinbefore, a measure of the effective load on the engine may be determined from a comparison of the a prevailing engine speed and a previous determination of engine speed.

On the basis of the known engine speed (detected at approximately 720 degrees BTDC), the adaption value, and the known decisions on events III, IV, V and VI, the controller predicts what the engine speed will be at point Y. Having preset speed limits and/or a target maximum speed, the controller then determines whether event VII should be a combustion event or a non-combustion event. This occurs so that the controller can effect feed-forward control of the engine speed to a target engine speed.

If the decision is that a combustion event is required, a full fuelling event is scheduled. For high load, high speed operation, the fuelling event VII will start shortly after that decision. Generally, a level of inherent delay in the system will form part of the delay from the decision to start the fuelling event and the actual start of fuel flow. If however the decision is that the event should be a non-combustion event, the fuel event is not commenced, and the air event is not scheduled, and does not occur.

The actual outcome of event VII in terms of its affect on the speed of the engine will not be known until approximately 180 degrees ATDC, as indicated at point Z in FIG. 1.

Once the actual outcome and the predicted outcome are known, they can be compared and the adaption value altered if necessary to reflect any changed conditions under which the engine is operating.

It should be understood that a system such as that described above can be used to provide feed-forward overspeed control to bring the speed of an engine to within a target value. This occurs by predicting what the engine speed will be after one or a number of future fuelling events should engine operating conditions remain unchanged. Based on this prediction, the combustion events can be enabled or cancelled in order to achieve a predetermined target engine speed. Such an overspeed control system would typically be implemented such that the system only becomes operational once a predetermined entry speed has been surpassed, that is, once the engine speed gets within a certain range of the target speed.

Figure 2:
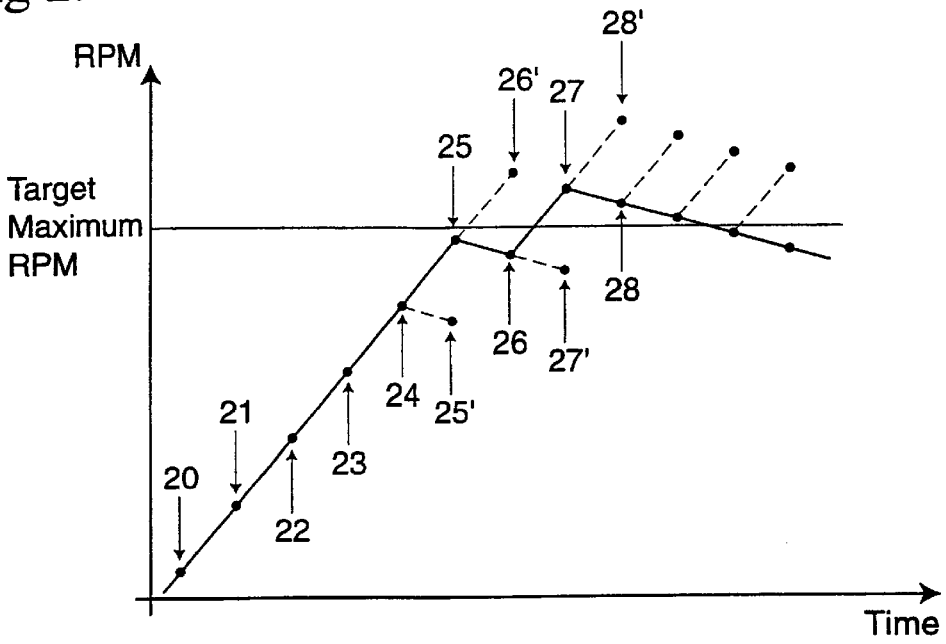
FIG. 2 is an illustrative mapping of engine speed over time for high speed operation where there exists a low effective load on the engine.
Figure 3:
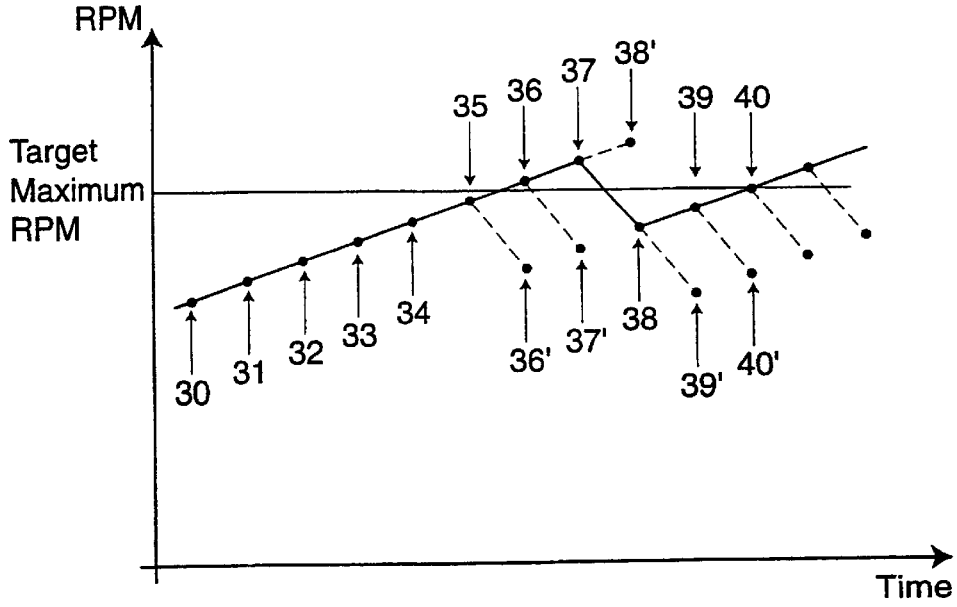
FIG. 3 is an illustrative mapping of engine speed over time for high speed operation where there exists a high effective load on the engine.

To better understand the process of determining whether a combustion event will occur or not, consideration is now given to FIGS. 2 and 3. Both of these figures show illustrative examples of how engine speed might be affected over time when the present invention is applied to engine operation.

FIG. 2 in particular illustrates a scenario where the engine is operating under relatively low load conditions. Under such conditions, it can generally be said that a combustion event will have a greater impact on the current speed, increasing it significantly, whilst a non-combustion event will have a lesser impact on the current speed, reducing it by a smaller amount. This is because the lower load allows a greater degree of "freewheeling" by the engine on non-combustion events, and because a lower resistance is provided to acceleration as a result of a combustion event due to the lower loading of the engine. For example, in regard to a PWC or marine engine, such a low load condition would equate to when the driving mechanism is out of the water.

FIG. 3 on the other hand illustrates a scenario where the engine is operating under relatively high load conditions. Under such conditions, a combustion event will have a lesser impact on the current speed, increasing it by a relatively small amount, whilst a non-combustion event will have a relatively greater impact on the current speed, decreasing it significantly. Once again, this is because the higher load provides a greater drag on the engine, making it tend to slow down, whilst providing a strong resistance to increases in speed. Again, taking the PWC or marine engine example, such a high load condition would equate to when the driving mechanism of the engine is pushing the craft through the water.

In relation to FIG. 2 in particular, it can be seen that in the initial period shown in the graph, the engine speed is increasing steadily towards the target maximum. Each point on the graph represents a combustion event, and the solid line indicates the actual speed of the engine, with the dotted lines representing the engine controller's prediction of the speed which would have been attained if the opposite decision had been made as to whether a combustion or non-combustion event was to take place. The engine speed is assumed to have exceeded a threshold entry speed such that the method of the present invention is now being used to predict the future engine speed.

At around the time of the event 20, the decision as to whether event 24 should be a combustion event or not is made. The controller determines that a combustion event will result in an outcome speed as indicated at event 25 and that a non-combustion event will result in an outcome speed as indicated at event 25'. As both of the alternative speeds are below the target maximum speed, the controller selects the higher of these two speeds as being acceptable, and schedules a combustion event. As such the engine speed continues to rise to event 25.

At around the time of the event 21, the decision as to whether event 25 should be a combustion event or not is made. The controller determines that a combustion event will result in an outcome speed as indicated at event 26' and that a non-combustion event will result in an outcome speed as indicated at event 26. As the speed indicated by event 26 is nearer to the target speed than the speed indicated at event 26', a non-combustion event is selected and as a result the speed will drop to that indicated at event 26. This procedure is continued, with the target maximum speed being sought by the engine controller until the engine operator allows the RPM to fall below the target range, and normal operation is resumed. That is, once the engine speed falls below the threshold entry speed, the method of the present invention is not used and normal operation resumes.

A similar procedure is followed in relation to the high load scenario illustrated in FIG. 3. The engine speed initially increases at a slower rate to the low load scenario, due to the higher load on the driving mechanism of the engine. The decision as to whether event 35 should be a combustion event or not is made at around the time of event 31. The controller determines that a combustion event will result in an outcome speed as indicated at event 36 and that a non-combustion event will result in an outcome speed as indicated at event 36'. As the speed indicated by event 36 is nearer to the target speed than the speed indicated at event 36', a combustion event is scheduled and as a result the speed will rise to that indicated at event 36. Once again this procedure continues with event 37 being scheduled as a non-combustion event, causing a drop in RPM to the level indicated at event 38.

In FIG. 3, the adaption parameter is set to indicate high load operation. As such, the estimate of the future speed on which the decision to provide a combustion event or a non-combustion event is based will be lower than if the adaption parameter was set for low load. This is clearly indicated in FIG. 3 in that the predicted fall in RPM resulting from a non-combustion event is substantially greater than the predicted fall in the case of a non-combustion event illustrated in FIG. 2 in which the adaption parameter is set to indicate low load operation. Similarly, the predicted rise in RPM resulting from a combustion event in the case of FIG. 3 is substantially lower than the predicted rise resulting from a combustion event illustrated in FIG. 2.

Under steady state conditions, a repetitive pattern of combustion and non-combustion events may be established to maintain the target maximum speed. This pattern will be dependent on the adaption value allocated to the system at the time, and can be altered in accordance with the changing of the adaption value. Naturally, if operating conditions change, and cause a change in the engine speed, the pattern of combustion and non-combustion events can be altered to limit the engine speed to it's correct level. Further, the application of a repetitive pattern of combustion and non-combustion events to control engine speed would normally only occur once the engine speed had exceeded the predetermined threshold entry speed and hence was within a certain range of the target maximum speed.

Generally, the higher the loading on the engine during speed limitation by this method, the lower the number of non-combustion events per combustion event. Similarly, the lower the loading on the engine, the greater the number of non-combustion events per combustion event. For example, high speed/high load operation may involve a pattern of two combustion events for each noncombustion event, whilst high speed/low load operation may involve a pattern of three non-combustion events for each combustion event.

It needs to be understood that in circumstances where a repetitive pattern or sequence of combustion and non-combustion events is established to control the engine speed, each combustion event uses a normal, mapped fuelling amount. This method of control of the engine speed reduces the average fuelling level supplied to the engine over a number of events without altering the normal, mapped fuelling levels. Therefore, there is no need for the engine to operate under a variety of air/fuel ratios when the engine is operating at or close to a preset maximum speed, thereby reducing the possible risks of detonation and engine over-heating.

By selecting a preset sequence of combustion and non-combustion events, the effective fuelling of the engine can be controlled as is shown below. The following example shows typical results achievable in a two-cylinder engine.

| SEQUENCE | EFFECTIVE FUELLING |
|---|---|
| 1 non-combustion event every 3 events for one cylinder (ie: 5 of 6 engine events are maintained) | 0.83 × normal fuelling level |
| 1 non-combustion event every 2 events for one cylinder (ie: 3 of 4 engine speed events are maintained) | 0.75 × normal fuelling level |
| 1 non-combustion event every 3 events for both cylinders (ie: 4 of 6 engine events are maintained) | 0.66 × normal fuelling level |
| 1 non-combustion event every 2 events for both cylinders (ie: 2 of 4 engine events are maintained) | 0.5 × normal fuelling level |
| 2 non-combustion events every 3 events for both cylinders (ie: 2 of 6 engine events are maintained) | 0.33 × normal fuelling level |
| 3 non-combustion events every 4 events for both cylinders (ie: 2 of 8 engine events are maintained) | 0.25 × normal fuelling level |
| 4 non-combustion events every 5 events for both cylinders (ie: 2 of 10 engine events are maintained) | 0.2 × normal fuelling level |

By controlling the engine speed using such a method, the user is able to experience a smooth, repeatable engine tone. This is desirable in marine applications, particularly PWC applications, as such craft often experience considerable time both in and out of the water at high speeds. Furthermore, a simple form of the strategy wherein different preset sequences are implemented based on the corresponding achievement of different predetermined threshold engine speed levels may be particularly applicable to certain outboard marine engines which may at times operate close to an upper threshold speed limit but in a reasonably steady or stable operating environment.

Whilst much emphasis has been placed upon utilising the described system and method to control engine over-speed conditions, the system and methods described are equally applicable to other scenarios where engine speed needs to be limited and/or controlled. Such applications could extend to use as a "child mode" or "novice mode" of operation, whereby the engine speed of various vehicles/crafts is limited to allow safe operation by children and the like. The described system and method could also be employed as a "limp-home" mode for various engines whereby the need to maintain the engine speed below a low threshold speed is required to avoid further engine damage or failure.

Hence, the method and system as described above may provide substantial benefits for the operation and maintenance of an engine to which it is applied. The potential for damage to the engine is greatly reduced by the avoidance of over-revving of the engine in situations where such over-revving has been known to occur in the past. Such situations include applications where load may be suddenly removed from the engine. A good example of this is in the use of a personal water craft, where the craft may become airborne, causing a sudden loss in loading on the engine, and a resultant surge in engine speed.

The present method and system is particularly (though not exclusively) applicable for use in dual fluid fuel and air injection systems where fuel metering is performed independently of fuel delivery to the engine combustion chambers. Such a system is particularly conducive to the application of the present invention which enables both the fuel and air event for a combustion event to be cut providing for a more satisfactory reinstatement of engine operation.

Although the present invention has been described in relation to particular embodiments and applications, it is envisaged that the invention will have broad applicability to a range of apparatus in the relevant field. The embodiments of the present invention have been advanced by way of example only, and modifications and variations therefrom are possible without departing from the scope of the appended claims.

What is claimed is:

1. A method of controlling the engine speed of an internal combustion engine, the method providing the steps of determining the speed of the engine at a given time, determining the change in the speed of the engine from a previous determination of the engine speed, and using the values for engine speed and change in engine speed to determine whether a future event should be a combustion event or a non-combustion event wherein the engine has a direct injection system and a fuel event is not scheduled when it is determined that a non-combustion event is required.

2. A method according to claim 1, wherein the determination of the change in the speed of the engine from the previous determination of engine speed provides an indication of the effective load on the engine.

3. A method according to claim 2, wherein the determination of the effective load on the engine is applied to provide for feed forward control of the engine speed.

4. A method according to claim 1, including firstly predicting what the engine speed will be after at least one fuelling event in the future if the operating conditions remain unchanged, and then deciding whether the next event to be scheduled should be a combustion event or a non-combustion event so as to target a predetermined engine speed setting.

5. A method according to claim 1, including supplying no fuel to an engine cylinder when it is determined that a said non-combustion event is required.

6. A method according to claim 5, including preventing ignition within an engine cylinder when it is determined that a said non-combustion event is required.

7. A method according to claim 1, wherein the engine has a two-fluid direct fuel injection system.

8. A method according to claim 7, wherein a decision as to whether a particular event is to be a combustion event or a non-combustion event is made prior to the fuel metering event for that event.

9. A method according to claim 1, including determining whether a future event is to be a combustion event or a non-combustion event at over 360 degrees BTDC relative to the occurrence of said future event.

10. A method according to claim 9, including determining the future event at about 710 degrees BTDC relative to the occurrence of said future event.

11. A method according to claim 1, including applying said method during high speed operation of the engine to thereby avoid the occurrence of overspeed conditions.

12. A method according to any one of claims 1, 2, and 6, including controlling the engine speed to a threshold target engine speed.

13. A method according to claim 12, including applying the method once the engine speed exceeds a predetermined entry speed.

14. A method according to claim 13, including setting the entry speed at a value lower than the threshold target speed to which the engine speed is controlled.

15. A method according to any one of claims 1, 2, and 6, including calculating an adaption value on the basis of engine speed and effective load levels as determined for the future event, the adaption value being used in determining whether the future event should be a said combustion event or a said non-combustion event.

16. A method according to claim 15, wherein when the effective load is high, the adaption value is set so as to increase the likelihood of a said combustion event as compared to a said non-combustion event, and wherein when the effective load is low, the adaption value is set so as to increase the likelihood of a said non-combustion event as compared to a said combustion event.

17. A method according to claim 15, wherein a filter is applied to the rate of change of the adaption value to limit the rate of change of the adaption value.

18. A method according to claim 17, wherein the filter is dependent on whether the load on the engine is increasing or decreasing.

19. A method according to claim 18, wherein the fuelling level supplied to the engine is used as an indication of the load on the engine.

20. A method according to any one of claims 1, 2, and 6, wherein a preset pattern of combustion events and non-combustion events is implemented in at least one engine cylinder to control the engine speed.

21. A method according to any one of claims 1, 2, and 6, wherein the method is employed as a limp-home mode whereby the need to maintain the engine speed below a low threshold speed is required to avoid engine damage or failure.

22. A control system for controlling an internal combustion engine utilizing a method according to claim 1.

23. An engine control unit (ECU) implemented to control an internal combustion engine in accordance with a method according to claim 1.

24. A control system for an internal combustion engine in which current engine speed and the change in engine speed from a previous determination are taken into account when determining whether a future event should be a combustion event or a non-combustion event.

25. A control system according to claim 24, wherein the system targets a predetermined threshold engine speed and schedules a sequence of at least one of combustion events and non-combustion events for maintaining the engine speed as close to the target engine speed as possible.

26. A control system according to claim 24, wherein the system is further adapted to provide for limitation of overspeed conditions in the use of the internal combustion engine.

27. A control system according to claim 24, wherein the system provides an adaption value, which is calculated on the basis of engine speed and the effective load levels as determined for the future event, the adaption value being used in determining whether the future event should be a combustion event or a non-combustion event.

28. A method of controlling the rotational speed of an internal combustion engine, the method including the steps of determining whether the engine speed is likely to exceed a predetermined threshold engine speed, and implementing a pattern of combustion events and non-combustion events in at least one engine cylinder in order to modify the effective fueling level to the engine cylinders so as to control the engine speed in relation to the threshold engine speed.

29. A method according to claim 28, wherein the prevailing fuelling level for an individual cylinder in which a combustion event is to occur is not altered.

30. A method according to claim 23, wherein the method of controlling the speed of the engine is affected so as to limit the engine speed.

31. A method according to claim 28, wherein the requirement for reduced speed is determined on the basis of both the engine speed and the effective load on the engine whereby the latter is established by determining the change in speed from a previous determination thereof.

32. A method according to claim 31, wherein the effective load on the engine required to maintain the engine speed at the threshold engine speed, or said effective fuelling level is used to select one of a number of preset patterns of combustion events and non-combustion events.

33. A method according to claim 28, wherein the method is used to avoid overspeed conditions in the engine operation.

34. A method according to claim 28, wherein the pattern of combustion events and non-combustion events provide a greater number of non-combustion events per sequence when there are effectively lower load conditions on the engine, and a lower number of non-combustion events per sequence when the engine effectively experiences higher load conditions.

35. The method as recited in claim 1, wherein the engine has a single fluid direction injection system.

* * * * *